US007335038B2

(12) United States Patent
Duval

(10) Patent No.: US 7,335,038 B2
(45) Date of Patent: Feb. 26, 2008

(54) LOCKING LEVER FOR A CONNECTOR

(75) Inventor: Frédéric Duval, Aviron (FR)

(73) Assignee: Connecteurs Electriques Deutsch, Evreux Cedex (FR)

( * ) Notice: Subject to any disclaimer, the term of this patent is extended or adjusted under 35 U.S.C. 154(b) by 0 days.

(21) Appl. No.: 11/442,289

(22) Filed: May 30, 2006

(65) Prior Publication Data

US 2006/0270257 A1 Nov. 30, 2006

(30) Foreign Application Priority Data

May 31, 2005 (FR) ..... 05 05505

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 5,308,254 A 5/1994 Hatagishi et al.
5,474,462 A 12/1995 Yamanashi et al.
5,562,465 A * 10/1996 Taguchi et al. ..... 439/157
6,655,971 B2 * 12/2003 Maegawa ..... 439/157
2002/0182491 A1 12/2002 Maegawa
2006/0234535 A1 * 10/2006 Ohtaka et al. ..... 439/157

* cited by examiner

*Primary Examiner*—James Harvey
*Assistant Examiner*—Travis Chambers
(74) *Attorney, Agent, or Firm*—Young & Thompson

(57) ABSTRACT

Locking lever (5) for a connector, the connector (1) comprising a first, fixed plug part (2) and a second plug part (3) that can be connected to the first plug part by displacement in one connection direction (X), the locking lever comprising two end parts that can be pivotally fixed, along one axis (Y) that is essentially perpendicular to the connection direction, on two opposite surfaces (12) of the first plug part. Each of the end parts includes a cam track, the locking lever being able to pivot between a release position, in which one open end of each of the cam tracks can be positioned at a catch of the second plug part, and a locking position in which each of the catches can be positioned in a locking portion of the cam track, the end portion being capable of being elastically deformed to allow the catch to penetrate into the locking portion.

6 Claims, 3 Drawing Sheets

LOCKING LEVER FOR A CONNECTOR

The object of this invention is a locking lever for a connector.

This invention relates especially to, although it is not limited to, a locking lever allowing rapid connection and disconnection of electronic units in an aircraft, the electronic units being used for, for example, video and/or audio applications.

In the case of such connections, contact elements of a first plug part that is made in the form of a cable bundle plug are detachably connected to the opposite contact elements of a second plug part that is made in the form of a plug contained in an electronic unit.

The operations of connection and disconnection of such interlocking elements can prove difficult to perform when mechanical constraints are significant during connection. Moreover, a bad connection runs the risk of causing faulty contacts or even damaging the contact elements.

In general, electronic units are arranged under aircraft seats. This presents the problem that the passenger seated on the seat may actuate the electronic unit. Moreover, the first and second plug parts run the risk of moving relative to one another, which can lead to disconnection of the electronic unit. Thus, such a connection engenders problems of reliability and safety.

The purpose of this invention is to propose a locking lever for a connector that eliminates at least some of the aforementioned problems, which allows a simpler connection and disconnection of two plug parts and which makes it possible to keep the two plug parts in a connected position.

For this purpose, the object of the invention is a locking lever for a connector, said connector comprising a first, fixed plug part and a second plug part that can be connected to said first plug part by displacement in one connection direction, said locking lever comprising two end parts that can be pivotally attached, along one axis that is essentially perpendicular to said connection direction, on two opposite surfaces of said first plug part, characterized in that each of said end parts includes a cam track, said locking lever being able to pivot between a release position in which one open end of each of said cam tracks can be positioned at the level of a catch of said second plug part, and a locking position in which each of said catches can be positioned in a locking portion of said cam track, said end portion being capable of being elastically deformed to allow said catch to penetrate into said locking portion and to apply a compression force between said first plug part and said second plug part.

According to one embodiment of the invention, each of said end parts includes a groove extending along a portion of said corresponding cam track, one end of said groove emptying into one end of said cam track, such that said cam track with said groove defines a tab that can be elastically deformed to allow deformation of said end part in response to a pressure force applied to said tab of said cam track.

Preferably when said locking portion includes a notch formed in said tab, said tab is able to assume a stable position by elasticity once said catch is positioned in said notch to support the connection force.

According to one embodiment of the invention, said second plug part is connected to an electronic unit, said first plug part being connected to an electronic device integrated into a vehicle, said first plug part being attached to said vehicle.

Advantageously, the locking lever includes two lateral branches interconnected by a transverse crosspiece, said lateral branches being able to extend along the two opposite surfaces of said electronic unit when said locking lever is in said locking position.

Preferably, said crosspiece can extend essentially parallel to one surface of said electronic unit when said locking lever is in said locking position, at least one part that forms a grip of said crosspiece being offset from said surface of said unit.

According to one embodiment of the invention, said vehicle is an aircraft, said electronic unit being located under the seat part of a seat of said aircraft such that when said locking lever is in said locking position, said locking lever is essentially parallel to the plane of said seat part, said seat part being able to rest on said locking lever to keep said locking lever in said locking position.

The invention will be better understood, and other objectives, details, characteristics and advantages of the latter will become more clear from the detailed explanatory description below of one embodiment of the invention given by way of purely illustrative and nonlimiting example, with reference to the attached schematic drawings.

Figure 1:
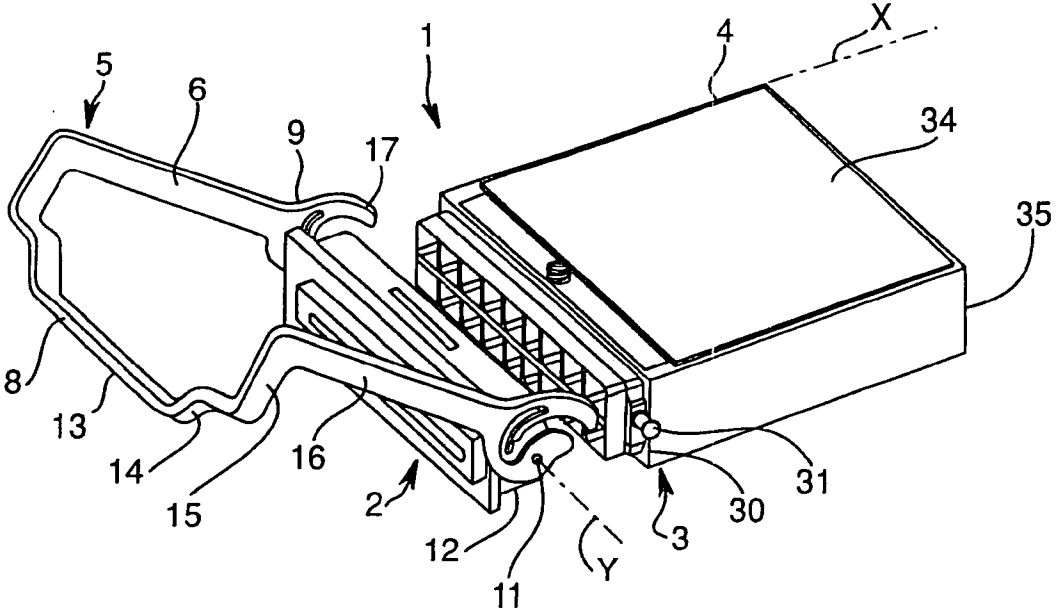
FIG. 1 is a simplified perspective view of one connector comprising a locking lever according to one embodiment of the invention.

With reference to FIG. 1, a connector 1 is shown that comprises a first plug part 2 and a second plug part 3 that are designed to be joined to one another by interlocking. The first part 2 is connected to an electronic device (not shown) that is, for example, integrated into an aircraft structure, the first part 2 being stationary relative to the structure. The second part 3 is connected to an electronic unit 4. The electronic unit is designed to be placed under the seat part of a seat (not shown) of the aircraft. The second part 3 can be connected to the first part 2 by displacement in a connection direction X.

The second part 3, for example, comprises a plurality of plug sockets arranged in a line as contact elements (not shown). In the connected position, the plug sockets are designed to surround the opposite contact elements (not shown) of the first part 2, for example, of pins. Such a connector is known in the art.

The connector 1 includes a locking lever 5 in the shape of a U. The lever 5 comprises two essentially identical lateral branches 6 that are interconnected by a transverse crosspiece 8. The lateral branches 6 extend parallel to one another.

Figure 8:
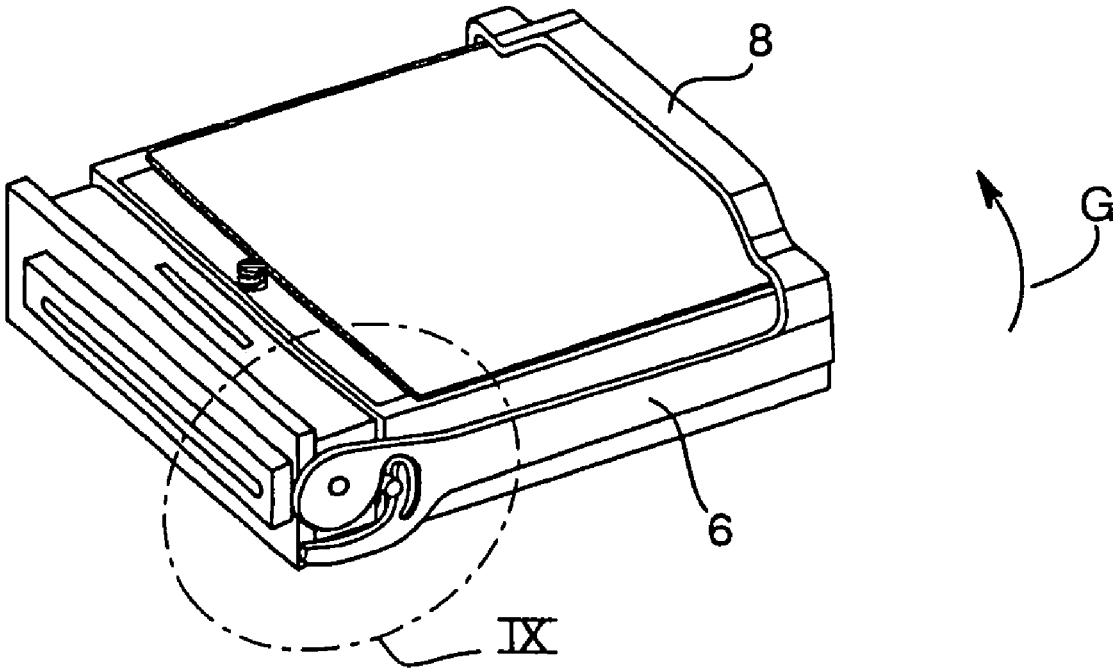
FIG. 8 is a view similar to FIG. 1, the locking lever being in the locking position.

The free ends 9 of the branches 6 are pivotally mounted on the pivot elements 11 located on the two opposite lateral surfaces 12 of the first part 2. The locking lever 5 can thus pivot relative to the first part 2 around the Y axis that is essentially orthogonal to the X axis, between a neutral position (FIG. 1) and a locking position (FIG. 8).

The crosspiece 8 comprises a central part 13 that acts as a grip during manipulation of the lever 5 such as will be described in detail below.

Each branch 6, starting from the crosspiece 8, has a rectilinear middle part 16 arranged to form a right angle with the corresponding end part 15. At the level of the free end 9, each branch 6 comprises a terminal part 17.

Each terminal part 17 is essentially flat and is located in the same plane as the middle part 16. Each terminal part 17 includes a groove 18 that defines a cam track, the curvature of the cam track 18 being aligned such that the cam track 10 winds around the pivot 11. One end 19 of the cam track 18, located on one side of the terminal part 17, defines an opening 20. The distance of the cam track 18 to the pivot 11 decreases from its end 19 toward the opposite end 24 of the cam track 18. A groove 21 extends along one portion 22 of the cam track 18, one end 23 of the groove 21 emptying into the end 24. In this way, the cam track 18 with the groove 21 defines a tab 25 that can be elastically deformed in response to a force of pressure applied to the tab 25 of the cam track 18, such as will be described in detail below.

The second part 3, on each of the two opposite lateral surfaces 30, corresponding to the surfaces 12 comprises a catch 31 that can engage in the cam track 18. The catches 31 are arranged such that when the second part 3 is abutted against the first part 2, each catch 31 is located at one of the openings 20.

In the vicinity of the end 24, the tab 25 includes a rounded notch that defines a recess 32 that can receive the catch 31 in the locking position of the lever 5.

An operation of connection of the first and second parts 2 and 3 proceeding from the neutral position of the lever 5 that is shown in FIG. 1 will now be described.

Figure 2:
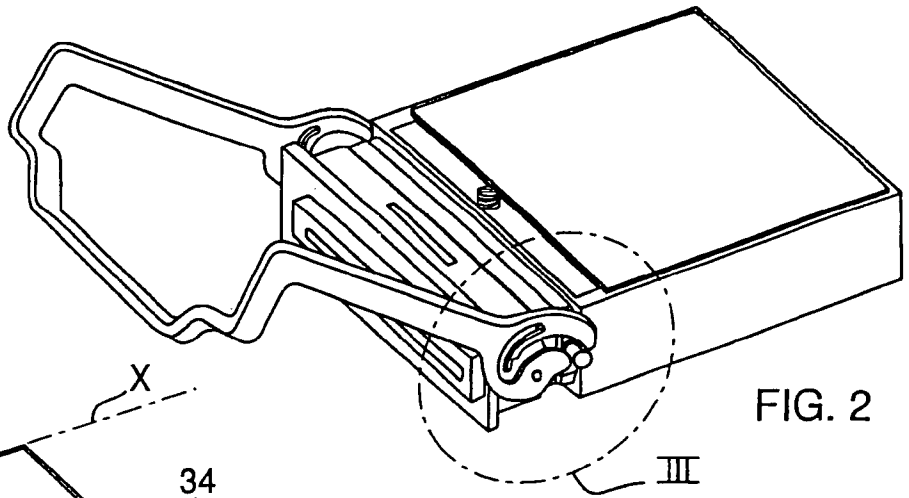
FIG. 2 is a view similar to FIG. 1, the locking lever being in a neutral position, the catches of the second plug part abutting the lever.
Figure 3:
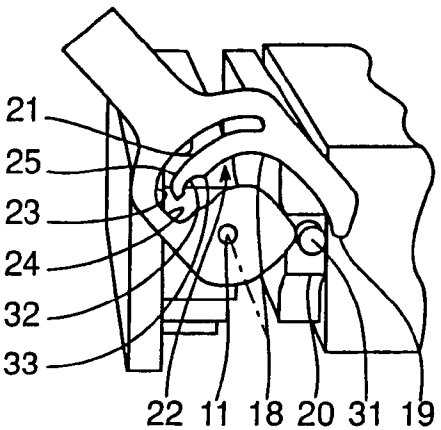
FIG. 3 is an enlarged view of the zone III from FIG. 2.

In this position, a user moves the second part 3 closer to the first part 2 until each notch 31 abuts against the corresponding opening 20 of the lever 5. This position is shown in FIGS. 2 and 3.

Figure 4:
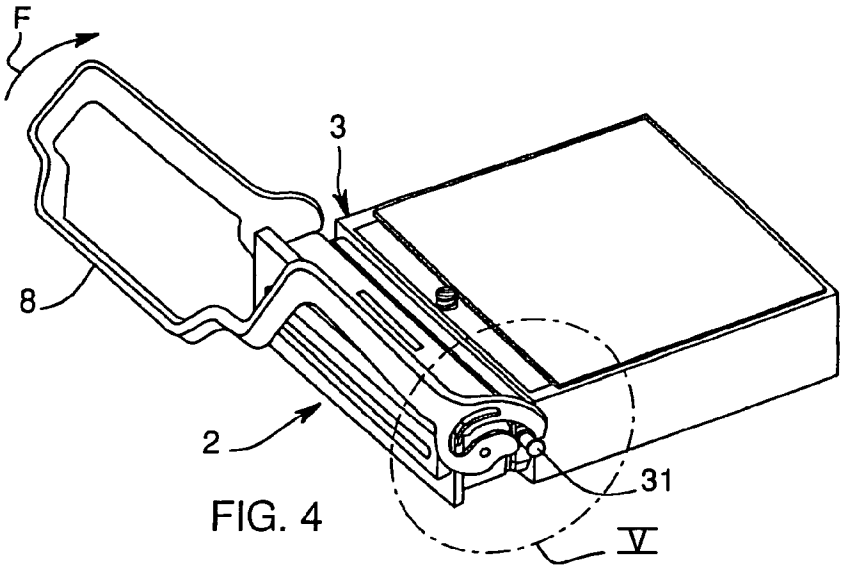
FIG. 4 is a view similar to FIG. 1, the catches of the second locking part being inserted into the cam tracks of the locking lever.
Figure 5:
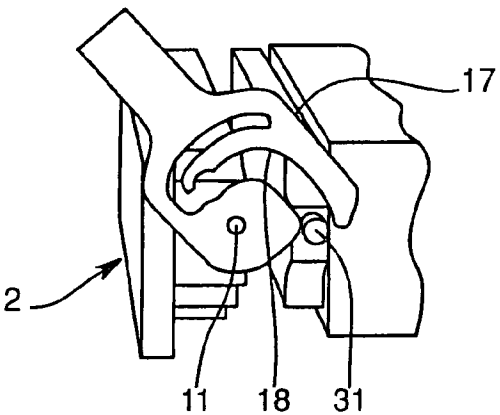
FIG. 5 is an enlarged view of the zone V from FIG. 4.

When the second part 3 has thus been positioned relative to the first part 2, the user makes the lever 5 pivot in the direction of the arrow F (FIG. 4), i.e., toward the locking position. This results in the insertion of each catch 31 into the corresponding cam track 18. This position is shown in FIGS. 4 and 5.

Proceeding from this position, when the user continues to make the lever 5 pivot in the direction of the arrow F, each catch 31 slides into the corresponding cam track 18 in the direction of the end 24. At the same time, the second part 3, under the effect of the cam tracks 18 acting on the catches 31, engages in the first part 2. When the first part 2 abuts against the second part 3, the tab 25 begins to deform elastically, due to the force of pressure applied by the catch 31 to the tab 25.

Figure 6:
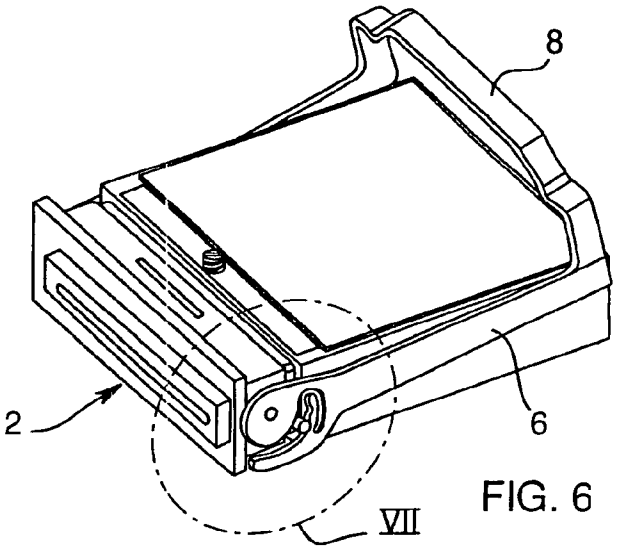
FIG. 6 is a view similar to FIG. 1, the cam tracks being deformed by pressure applied by the catches.
Figure 7:
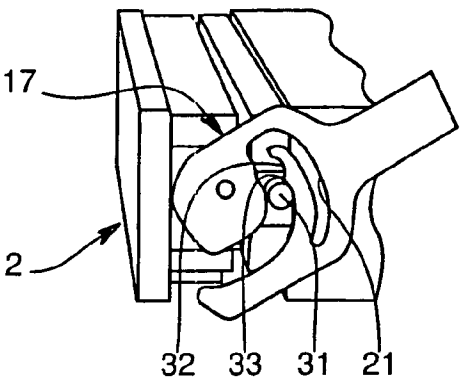
FIG. 7 is an enlarged view of the zone VII from FIG. 6.
Figure 9:
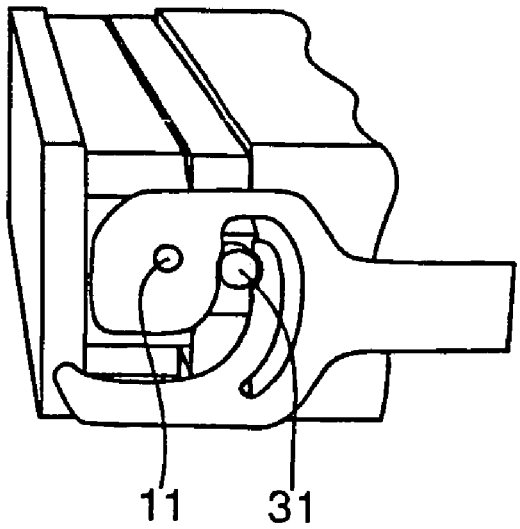
FIG. 9 is an enlarged view of the zone IX from FIG. 8.

When the catch 31 moves into the vicinity of the corresponding recess 32, the force of pressure applied by the catch 31 to the tab 25 is maximum, the deformation of the tab 25 thus being likewise maximum. This position is shown in FIGS. 6 and 7. At this instant, if the user continues to make the lever pivot, the deformation of the tab 25 allows the catch 31 to be positioned in the recess 32, such as is shown in FIGS. 8 and 9.

When the catch 31 is in the recess 32, the tab 25 assumes a stable position by elasticity, which results in the formation of a friction point 33 that makes it possible to keep the catch 31 in the recess 32 and to apply a compressive force between the parts 2 and 3. This makes it possible especially to compensate for the tolerance gaps of the coupling. In this position, the contact elements of the first and second parts 2 and 3 are correctly connected.

Moreover, in this position, the central part 13 of the crosspiece 8 extends parallel to the upper surface 34 of the unit 4, essentially parallel to the Y axis. End parts 15 of the crosspiece 8 extend along opposite lateral surfaces 35 of the unit, essentially perpendicular to the X axis. The branches 6 extend along lateral surfaces 35, essentially parallel to the X axis. The volume occupied by the lever 5 in the neutral position is thus minimized, the parts of the lever 5 having a small thickness and extending along the unit 4, as is shown in FIG. 8.

The lever 5, when it is in the locking position, is essentially parallel to the unit 4. This allows the unit 4 to be arranged under the seat part of an aircraft seat essentially parallel to the plane of the seat part, i.e., horizontally. The support of the seat part on the lever 5 helps keep the lever 5 in its horizontal position, i.e., in its locking position, which prevents involuntary disconnection of the unit 4. Moreover, a passenger cannot access the unit 4, the latter being located under the seat part of his seat.

A disconnection operation will now be described, proceeding from the locking position of the lever 5, the seat part of the seat having been removed to make the unit 4 accessible. When the user actuates the lever 5 to make it rotate around the Y axis in the direction of the arrow G (FIG. 8), the friction point 33 applies a force opposing the movement of the lever 5 to the catch 31. At this instant, if the user continues to actuate the lever in the same way, the tab 25 becomes deformed, which results in the catch 31 coming out of the recess 32. When the catch 31 has come out of the recess 32 and when the user continues to make the lever pivot in the direction of the arrow G, the catch 31 slides into the cam track 18 in the direction of the end 19. At the same time, the contact elements of the first part 2 disengage from the contact elements of the second part 3. When the lever 5 reaches its neutral position, the first and second parts 2 and 3 are disconnected.

The cam tracks 18 of the lever 5 thus allow a good distribution of forces during operations of connection and disconnection, which facilitates operations for the user. The lever likewise makes it possible to define the depth of insertion and to ensure guidance along the X axis of the second part 3 relative to the first part 2, which prevents twisting or breaking contact elements.

Although the invention has been described relative to one particular embodiment, it is quite apparent that it is in no way limited thereto and that it comprises all of the technical equivalents of the described means as well as their combinations if they fall within the framework of the invention.

The invention claimed is:

1. Locking lever (5) for a connector, said connector (1) comprising a first, fixed plug part (2) and a second plug part (3) that can be connected to said first plug part by displacement in one connection direction (X), said locking lever (5) comprising two end parts (9) that can be pivotally attached, along one axis (Y), essentially perpendicular to said connection direction, on two opposite surfaces (12) of said first plug part, each of said end parts including a cam track (18), said locking lever being able to pivot between a release position, in which one open end (20) of each of said cam tracks can be positioned at a catch (31) of said second plug part, and a locking position in which each of said catches can be positioned in a locking portion (32) of said cam track (18), said end part (9) being capable of being elastically deformed to allow said catch to penetrate into said locking portion and to apply a compression force between said first plug part and said second plug part, said second plug part (3) being connected to an electronic unit (4), said first plug part (2) being connected to an electronic device that is integrated into a vehicle, said first plug part being attached to said vehicle, the locking lever including two lateral branches (6) interconnected by a transverse crosspiece (8), said lateral branches being able to extend along the two opposite surfaces (35) of said electronic unit when said locking lever is in said locking position, characterized in that said vehicle is an aircraft, said electronic unit (4) being located under a seat part of said aircraft, such that when said locking lever (5) is in said locking position, said locking lever (5) is essentially parallel to the plane of said seat part, said seat part being able to rest on said locking lever (5) to keep said locking lever (5) in said locking position.

2. Locking lever according to claim 1, wherein each of said end parts (9) includes a groove (21) extending along a portion (22) of said corresponding cam track (18), an end (23) of said groove emptying into one end (24) of said cam track, such that said cam track with said groove defines a tab (25) that can be elastically deformed to allow deformation of said end part in response to a pressure force applied to said tab of said cam track.

3. Locking lever according to claim 2, wherein when said locking part (32) includes a notch formed in said tab (25), said tab is able to assume a stable position by elasticity once said catch (31) is positioned in said notch to support the connection force.

4. Locking lever according to claim 1, wherein said crosspiece (8) can extend essentially parallel to one surface (34) of said electronic unit (4) when said locking lever is in said locking position, at least one part that forms a grip (13) of said crosspiece being offset from said surface (34) of said electronic unit.

5. Locking lever (5) for a connector, said connector (1) comprising a first, fixed plug part (2) and a second plug part (3) that can be connected to said first plug part by displacement in one connection direction (X), said locking lever (5) comprising two end parts (9) that can be pivotally attached, along one axis (Y), essentially perpendicular to said connection direction, on two opposite surfaces (12) of said first plug part, each of said end parts including a cam track (18), said locking lever being able to pivot between a release position, in which one open end (20) of each of said cam tracks can be positioned at a catch (31) of said second plug part, and a locking position in which each of said catches can be positioned in a locking portion (32) of said cam track (18), characterized in that said end part (9) is capable of being elastically deformed to allow said catch to penetrate into said locking part and to apply a compression force between said first plug part and said second plug part, wherein each of said end parts (9) includes a groove (21) extending along a portion (22) of said corresponding cam track (18), an end (23) of said groove emptying into one end (24) of said cam track, such that said cam track with said groove defines a tab (25) that can be elastically deformed to allow deformation of said end part in response to a pressure force applied to said tab of said cam track.

6. Locking lever according to claim 5, wherein when said locking part (32) includes a notch formed in said tab (25), said tab is able to assume a stable position by elasticity once said catch (31) is positioned in said notch to support the connection force.

* * * * *